US008997701B2

(12) United States Patent
Hooper et al.

(10) Patent No.: US 8,997,701 B2
(45) Date of Patent: Apr. 7, 2015

(54) ROTARY SYNCHRONOUS CHARGE TRAPPING

(75) Inventors: Andrew Hooper, Rathdrum, ID (US); Coleman Bode, Moore, ID (US); Alexander Fuhrman, Greenacres, WA (US); Ty Lord, Arco, ID (US)

(73) Assignee: University of Idaho, Moscow, ID (US)

( * ) Notice: Subject to any disclaimer, the term of this patent is extended or adjusted under 35 U.S.C. 154(b) by 0 days.

(21) Appl. No.: 14/001,482

(22) PCT Filed: Feb. 24, 2012

(86) PCT No.: PCT/US2012/026573

§ 371 (c)(1),
(2), (4) Date: Aug. 23, 2013

(87) PCT Pub. No.: WO2012/161800

PCT Pub. Date: Nov. 29, 2012

(65) Prior Publication Data

US 2013/0327306 A1 Dec. 12, 2013

Related U.S. Application Data

(60) Provisional application No. 61/446,433, filed on Feb. 24, 2011.

(51) Int. Cl.
*F02D 13/02* (2006.01)
*F02B 75/02* (2006.01)
(Continued)

(52) U.S. Cl.
CPC ..... *F02B 75/02* (2013.01); *F01L 7/021* (2013.01); *F01L 7/12* (2013.01); *F01L 2250/04* (2013.01); *F01L 2820/01* (2013.01); *F02B 25/14* (2013.01)

(58) Field of Classification Search
CPC ..... F02B 2075/025; F02B 33/44
USPC ..... 123/65 R, 190.1, 69 V, 65 PE, 65 A
See application file for complete search history.

(56) References Cited

U.S. PATENT DOCUMENTS 4,325,335 A * 4/1982 Shibata ..... 123/323
4,388,894 A 6/1983 Tanaka et al.
(Continued)

FOREIGN PATENT DOCUMENTS

JP 11-022471 A 1/1999

OTHER PUBLICATIONS

International Search Report dated Dec. 14, 2012, issued by the Korean Intellectual Property Office in corresponding PCT Application No. PCT/US2012/026573, filed Feb. 24, 2012.
(Continued)

*Primary Examiner* — Noah Kamen
*Assistant Examiner* — Long T Tran
(74) *Attorney, Agent, or Firm* — Klarquist Sparkman, LLP

(57) ABSTRACT

An exemplary two-stroke internal combustion engine can comprise one or more cylinders comprising exhaust ports, one or more pistons configured to cyclically cover and uncover the exhaust ports during reciprocation of the pistons within the cylinders, and one or more rotary exhaust valves associated with each exhaust port. The exhaust valves can be configured to rotate around a valve axis that is substantially parallel to an axis of rotation of a crank shaft of the engine. Each exhaust valve at least partially obstructs the associated exhaust port during a portion of the exhaust valve's rotation about the valve axis while the associated exhaust port is at least partially uncovered by the associated piston, thereby trapping fresh charge within the combustion chamber.

22 Claims, 16 Drawing Sheets

(51) Int. Cl.

| | |
|---|---|
| ***F01L 7/02*** | (2006.01) |
| ***F01L 7/12*** | (2006.01) |
| *F02B 25/14* | (2006.01) |

(56) References Cited

U.S. PATENT DOCUMENTS

| | | | | | |
|---|---|---|---|---|---|
| 4,864,984 | A | * | 9/1989 | Blish | 123/190.2 |
| 4,867,117 | A | * | 9/1989 | Scalise | 123/190.8 |
| 4,924,819 | A | | 5/1990 | Boyesen | |
| 5,255,645 | A | * | 10/1993 | Templeton | 123/190.17 |
| 5,267,535 | A | * | 12/1993 | Luo | 123/65 PE |
| 5,331,927 | A | * | 7/1994 | Solomon et al. | 123/65 PE |
| 5,829,394 | A | * | 11/1998 | Oike et al. | 123/65 PE |
| 5,906,180 | A | * | 5/1999 | Wilke | 123/80 BA |
| 6,065,432 | A | * | 5/2000 | Zakharov et al. | 123/65 V |
| 6,415,748 | B2 | * | 7/2002 | Uchida et al. | 123/65 PE |
| 7,267,088 | B2 | * | 9/2007 | Ezaki et al. | 123/90.11 |
| 2005/0045122 | A1 | | 3/2005 | Yang | |

OTHER PUBLICATIONS

Written Opinion dated Dec. 14, 2012, issued by the Korean Intellectual Property Office in corresponding PCT Application No. PCT/US2012/026573, filed Feb. 24, 2012.

* cited by examiner

ROTARY SYNCHRONOUS CHARGE TRAPPING

CROSS REFERENCE TO RELATED APPLICATIONS

This is the U.S. National Stage of international Application No. PCT/US2012/026573, filed Feb. 24, 2012, entitled ROTARY SYNCHRONOUS CHARGE TRAPPING, which was published in English under PCT Article 21(2), and which claims the benefit of the earlier filing date of U.S. Provisional Patent Application No. 61/446,433, filed on Feb. 24, 2011, and entitled "ROTARY SYNCHRONOUS CHARGE TRAPPING." Each of these prior applications is incorporated by reference herein.

FIELD

This disclosure is related to two stroke internal combustion engines.

BACKGROUND

In conventional two stroke engines where the exhaust ports are opened and closed based on the position of the pistons, some of the fresh charge entering the cylinders can escape with the exhaust gas through the exhaust ports before the pistons close the exhaust ports during their compression strokes. The amount fresh charge that escapes with the exhaust can reduce torque output, reduce brake-specific fuel consumption, and increase undesirable emissions. Therefore, reducing the amount of fresh charge that escapes with the exhaust gas through the exhaust ports can be desirable.

SUMMARY

Described herein are exemplary embodiments of a two stroke engine that comprises rotary exhaust valves that are synchronized with the reciprocation of the pistons and help trap fresh charge within the cylinder.

Some exemplary embodiments of a two stroke internal combustion engine comprise one or more pistons coupled to a crank shaft and positioned within associated cylinders. The pistons cyclically cover and uncover the exhaust ports of the cylinders during reciprocation of the pistons within the cylinders. The engine further comprises an exhaust valve shaft positioned outside of the cylinders and rotatable about a valve axis that is substantially parallel to the crank shaft axis of rotation. The engine further comprises one or more exhaust valves associated with each exhaust port. The exhaust valves comprise a base portion fixed to the exhaust valve shaft and at least one head portion extending radially from the base portion. The exhaust valves and the exhaust valve shaft are continuously rotatable 360° about the valve axis, such as with the same angular velocity as the crank shaft and in an opposite direction of rotation. The head portion of each exhaust valve at least partially obstructs an outside of the associated exhaust port during a portion of each rotation of the exhaust valve about the valve axis.

Rotation of the exhaust valve shaft can be timed relative to rotation of the crank shaft such that the head portion of each exhaust valve at least partially obstructs the outside of the associated exhaust port while the inside of the exhaust port is at least partially uncovered by the piston. Desirably, the head portions are travelling in the opposite direction of the pistons when the head portions obstruct the exhaust ports.

In some embodiments, the one or more exhaust valves comprise at least two exhaust valve head portions associated with each exhaust port such that each exhaust port is obstructed at least two discrete times per each rotation of the exhaust valve shaft. For example, each exhaust valve can comprise a double-headed valve with two valve heads positioned about 180° apart from each other about the valve axis. In such embodiments, the exhaust valve shaft rotates with a reduced angular velocity, such as about equal to about one half of the angular velocity of the crank shaft.

Each head portion can comprise a face surface configured to match the geometry of the outside of the exhaust port, such as a saddle-shaped face surface. Desirably, the head portion of the valve passes within close proximity to the exhaust port without making contact.

In some embodiments, the engine comprises at least two cylinders with at least one exhaust valve associated with each of the cylinders. In a multi-cylinder engine, the exhaust valve associated with a first cylinder is angularly offset on the exhaust valve shaft relative to the exhaust valve associated with a second cylinder. In a two cylinder engine, the valves can be offset about 180° about the valve axis.

The engine can include a drive/timing mechanism coupling the crank shaft to the exhaust valve shaft that is configured to vary the timing of the exhaust valve shaft relative to the crank shaft. The timing can be varied based at least in part on rotational velocity of the crank shaft and a throttle position of the engine.

The engine can further comprise a valve housing coupled to each cylinder opposite the exhaust port. Each valve housing can comprise an inlet adjacent to and in exhaust receiving communication with the associated exhaust port, a valve chamber housing the one or more exhaust valves associated with the exhaust port, and an outlet for expelling exhaust from the valve housing.

An exemplary method of varying the timing of an exhaust valve shaft relative to a crank shaft can comprise: receiving a first signal indicating a rotational velocity of a crank shaft of a two-stroke internal combustion engine, the crank shaft being aligned substantially parallel with an exhaust valve shaft of the engine; and changing the rotational timing of the exhaust valve shaft relative to the crank shaft based at least in part on the first signal, thereby changing a timing of when an exhaust valve coupled to the valve shaft obstructs an exhaust port of a cylinder of the engine relative to when a reciprocating piston within the cylinder obstructs the exhaust port.

In some embodiments, changing the rotational timing of the exhaust valve shaft relative to the crank shaft can comprise: in response to the first signal indicating that the rotational velocity of the crank shaft exceeds a predetermined threshold, retarding the timing of the exhaust valve shaft relative to the crank shaft. In some embodiments, changing the rotational timing of the exhaust valve shaft relative to the crank shaft can comprise changing the percentage of the time during each revolution of the crank shaft when the exhaust port is at least partially opened by the piston and the exhaust port is at least partially obstructed by the exhaust valve.

The method can further comprise receiving a second signal indicating a throttle position of the engine, and changing the rotational timing of the exhaust valve shaft relative to the crank shaft can also be based at least in part on the second signal.

In some embodiments, retarding the timing of the exhaust valve shaft relative to the crank shaft comprises retarding the exhaust valve shaft to an effective degree, such as at least about 20° relative to the crank shaft. In some of these embodiments, the valve obstructs the exhaust port only when the exhaust port is completely obstructed by the piston.

Some exemplary methods further comprise receiving a second signal indicating an exhaust gas temperature and changing the rotational timing of the exhaust valve shaft relative to the crank shaft based at least in part on the second signal. In such embodiments, an increase in exhaust gas temperature can correspond with less retardation of the exhaust valve shaft relative to the crank shaft.

An exemplary embodiment of an exhaust valve assembly for a two-stroke internal combustion engine comprises an elongated exhaust valve shaft having a longitudinal center line that defines an axial direction along the center line, a radial direction extending perpendicular from the center line, and an angular direction extending around the center line. The assembly further comprises an exhaust valve fixed to the shaft, the valve extending radially from the shaft and comprising a radially-facing face surface. In some disclosed embodiments, the face surface is saddle shaped with a convex curvature in the angular direction and a concave curvature in the axial direction.

The face surface of the exhaust valve can comprise a lead edge at one angular end of the face surface and a trail edge at an opposite angular end of the face surface, the lead edge and the trail edge being asymmetric.

In some embodiments, the exhaust valve can comprise a double-headed valve that comprises a first radially-facing face surface and a second radially-facing face surface. In some of these embodiments, each face surface is saddle shaped with a convex curvature in the angular direction and a concave curvature in the axial direction, the first face surface being oriented about 180° in the angular direction relative to the second face surface. The first face surface can be substantially symmetrical to the second face surface about the shaft center line.

In some embodiments, the curvature of the face surface in the angular direction has a substantially constant radius from the shaft center line. In some embodiments, the curvature of the face surface in the axial direction has a substantially constant radius over at least 50% of the face surface.

The foregoing and other objects, features, and advantages of this disclosure will become more apparent from the following detailed description, which proceeds with reference to the accompanying figures.

DETAILED DESCRIPTION

General Considerations

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. The term "and/or" used between the last two of a list of elements means any one or more of the listed elements. For example, the phrase "A, B, and/or C" means "A," "B," "C," "A and B," "A and C," "B and C" or "A, B and C." The term "comprises" means "includes." The term "coupled" generally means physically coupled or linked and does not exclude the presence of intermediate elements between the coupled or associated items absent specific contrary language.

Exemplary Embodiments

Figure 1:
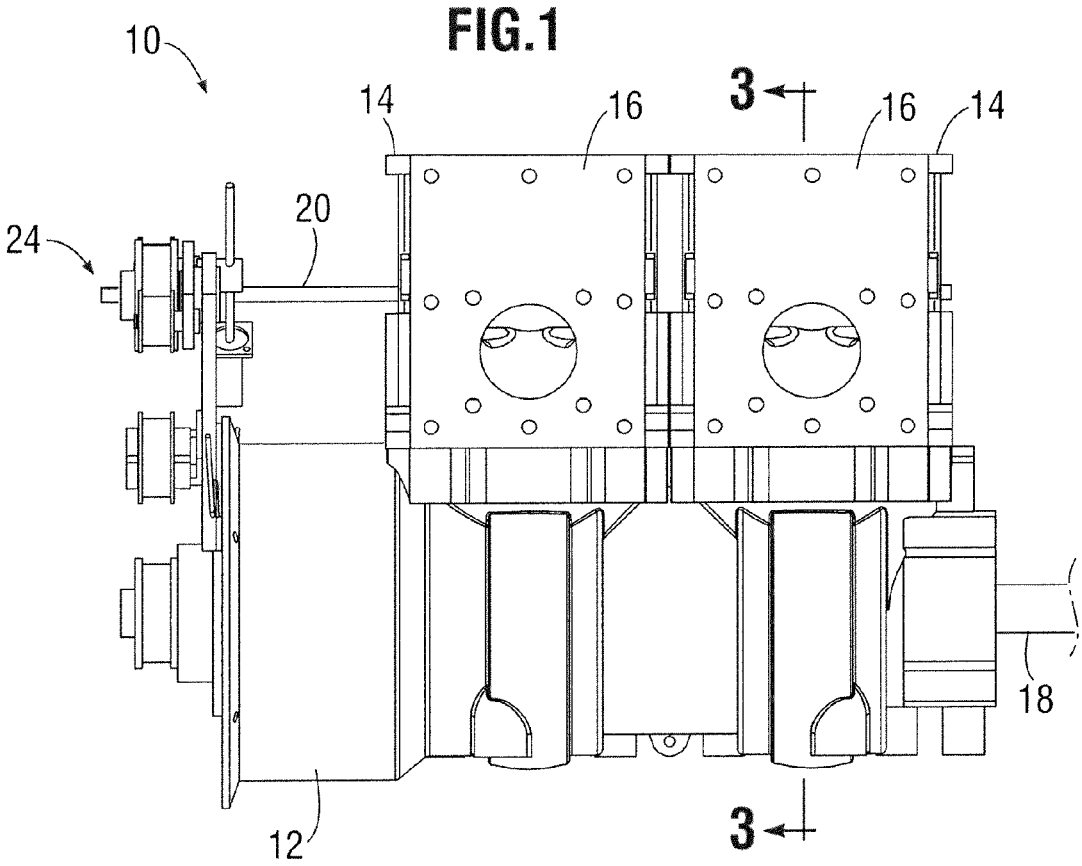
FIG. 1 is a side view of a portion of an exemplary two stroke engine comprising rotary exhaust valves.
Figure 2:
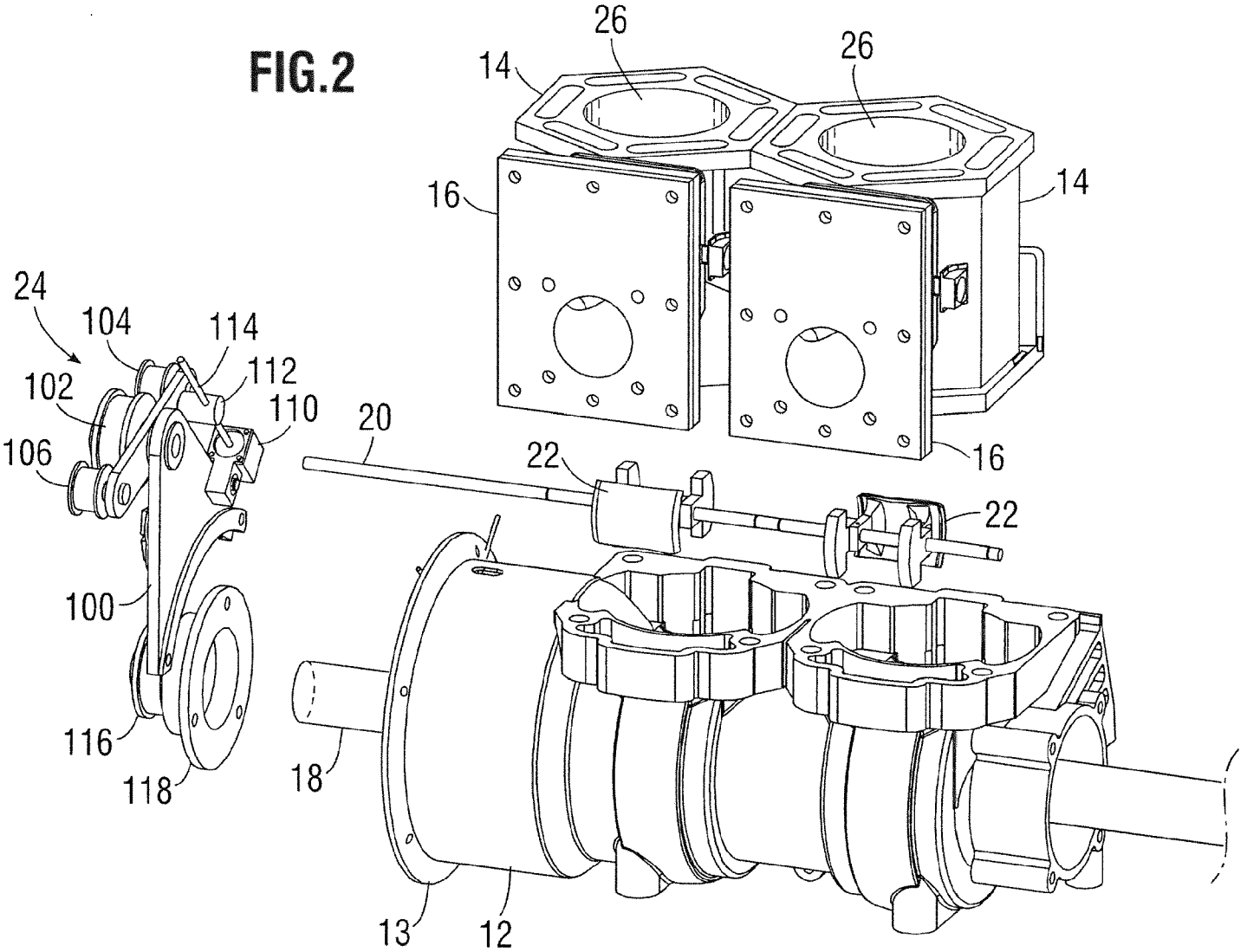
FIG. 2 is an exploded perspective view of the engine of FIG. 1.

FIGS. 1 and 2 show an exemplary embodiment of a two stroke engine 10 comprising rotary exhaust valves that are synchronized with the reciprocation of its pistons and help trap fresh charge within the cylinder. Though some of the accompanying figures show embodiments having two cylinders, the engine 10 can comprise any number of cylinders. Some embodiments comprise only one cylinder, while other embodiments comprise three or more cylinders. For clarity, however, the remainder of this disclosure proceeds with reference to engine embodiments with two cylinders. Furthermore, the engine 10 can be oriented in any manner. For clarity, however, the engine 10 is described herein in the orientation shown in FIG. 1. Thus, terms such as "top," "bottom," "upward," "downward," "horizontal," "vertical," and similar terms refer to the orientation shown of FIG. 1.

As shown in FIG. 2 the engine 10 can comprise a crank case 12, one cylinder, or jug, 14 for each piston 30 (see FIG. 3A), one exhaust valve housing 16 for each cylinder, a crank shaft 18 positioned within the crank case 12, an exhaust valve shaft 20, one or more exhaust valves 22 fixed to the exhaust valve shaft 20, and a timing mechanism 24. In some embodiments, the exhaust valve shaft 20 rotates parallel to the crank shaft 18 and in an opposite direction.

Figure 3A:
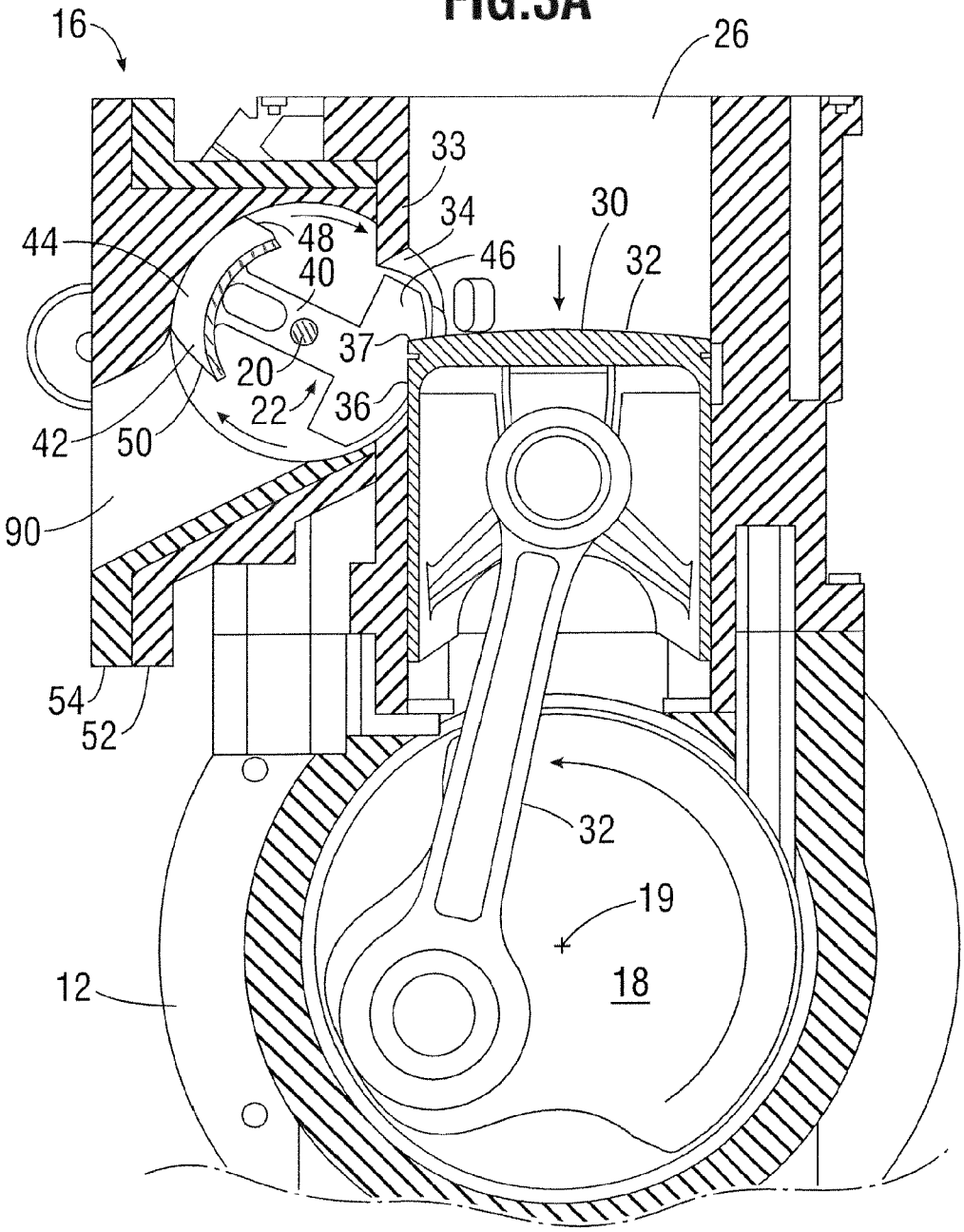
FIGS. 3A and 3B are cross-sectional views of the engine of FIG. 1, take along section line 3-3, at two different points during the engine's two-stroke cycle.
Figure 3B:
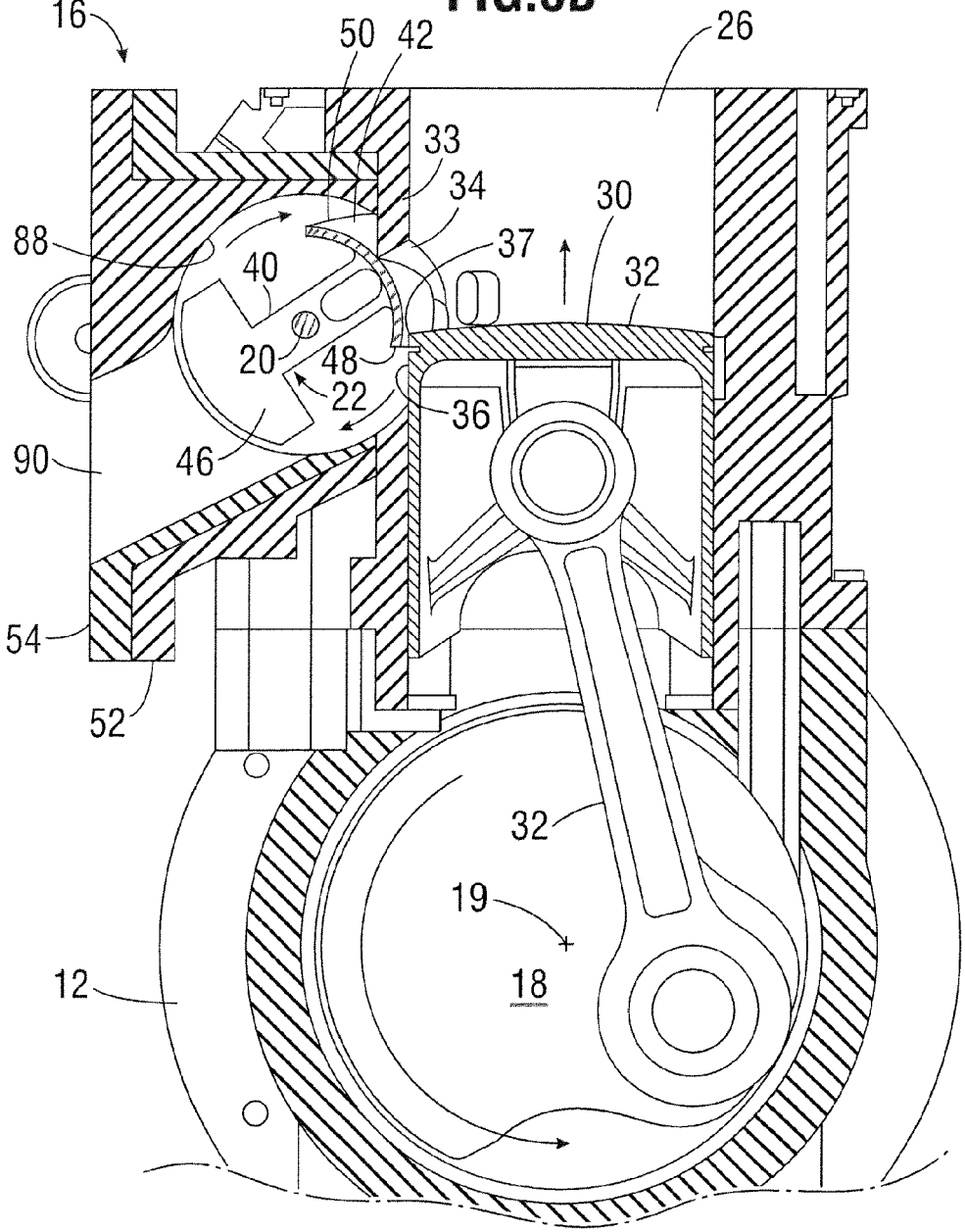
Figure 4A:
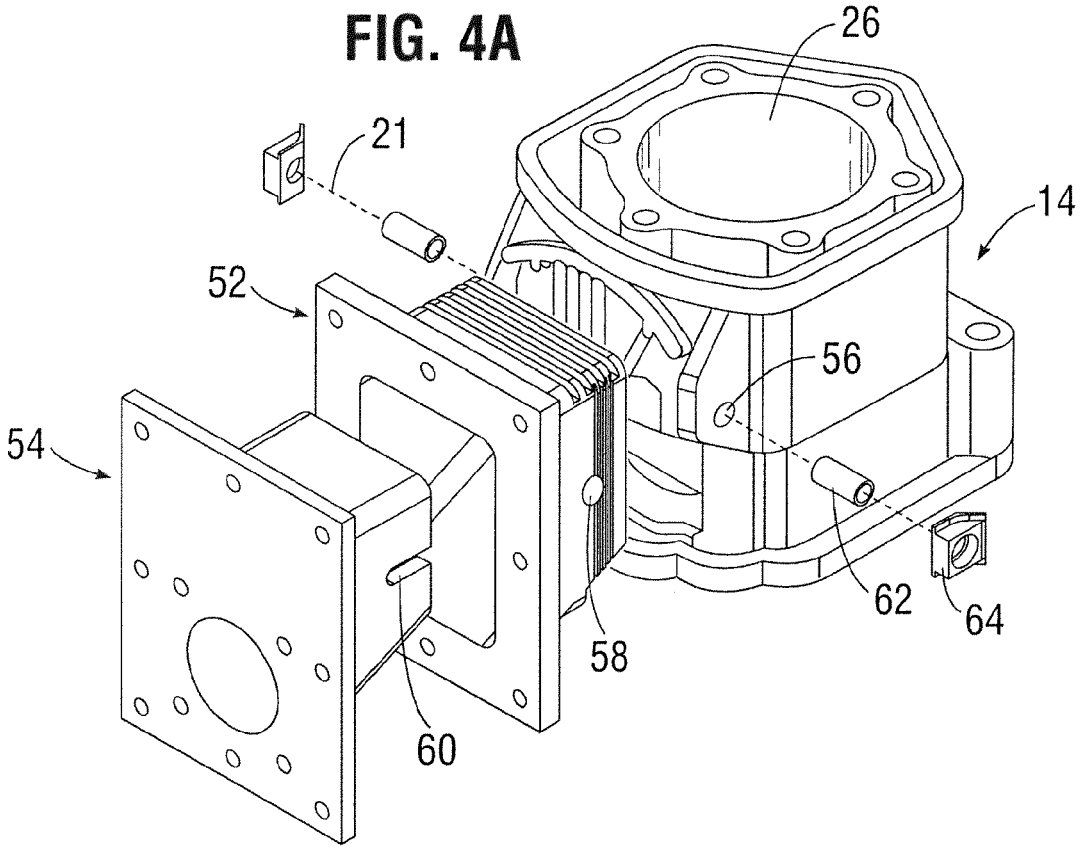
FIG. 4A is an exploded perspective view of an exemplary jug and exhaust valve housing of the engine of FIG. 1.
Figure 4B:
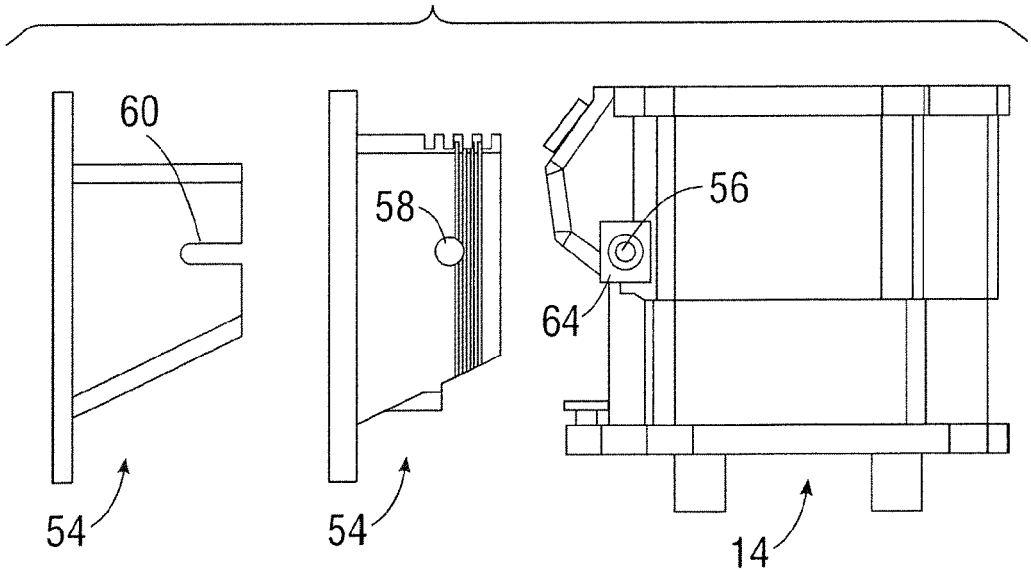
FIG. 4B is an exploded side view of the jug and housing of FIG. 4A.

As shown in FIGS. 3A and 3B, the crank shaft 18 is rotatable about crank shaft axis 19 within the case. The pistons 30 are coupled to the crank shaft 18 via rods 32 which drive the pistons in a reciprocating motion within the cylinder bores 26 of the jugs 14 with rotation of the crank shaft 18. The pistons 30 move in directions perpendicular to the crank shaft axis. The jugs 14 are coupled to the crank case 12 and contain the pistons 30 within the cylinder bores 26. The jugs 14 can further comprise cooling jackets and/or other features. Each of the jugs 14 can comprise a generally vertical side wall 33 and an exhaust port 34 passing through the side wall 33. The jugs 14 can further comprise any number of transfer ports and/or intake ports that supply fresh charge to the combustion chamber. In some embodiments, for example, the ports can be configured for loop-scavenging. Headers and other engine components can also be coupled to the jugs 14.

The opening and closing of the exhaust port 34 can be controlled by the piston 30. When a sidewall 36 of the piston covers the inside of the exhaust port 34, the exhaust port is closed. When the side wall 36 at least partially uncovers the inside of the exhaust port, the exhaust port is at least partially open and can allow gas within the bore 26 to exit through the exhaust port 34.

In the embodiment shown in FIGS. 3A and 3B, the piston 30 completely covers the exhaust port 34 when the piston is at top dead center (TDC). The piston 30 then gradually uncovers the exhaust port 34 during a portion of the piston's combustion stoke (see FIG. 3A). The exhaust port 34 is opened fully when the piston 30 is at bottom dead center (BDC). The piston 30 then gradually covers the exhaust port 34 during a portion of the piston's compression stroke (see FIG. 3B). During this cycle, the exhaust port 34 is at least partially open the entire time while the upper perimeter 37 of the piston (where the side wall 36 meets the upper surface 32) is below the top inner edge 69 of the exhaust port (see FIG. 5B), and the exhaust port 34 is fully uncovered by the piston 30 when the upper perimeter 37 is below the lower inner edge 71 of the exhaust port (see FIG. 5B). The exhaust port 34 is completely closed by the piston 30 when the upper perimeter 37 of the piston is above the upper inner edge 69 of the exhaust port.

The exhaust valve housings 16 can be coupled to the sidewalls 33 of the jugs 14, as shown in FIGS. 1-4. Each valve housing 16 can comprise an outer housing 52 and an inner housing 54. The outer housing 52 can be fixed to the sidewall 33, such as by welding, and the inner housing 54 can be removably coupled to the outer housing 52 using bolts or other releasable fasteners. As shown in FIG. 4A, the inner housing 54 nests within the outer housing 52 such that slots 60 in the inner housing align with openings 58 in the outer housing 58. The slots 60 and openings 58 are aligned with openings 56 in the jug 14. A cylindrical bushing 62 can extend through the openings 56 and 58 and the slots 60 on either side of the housing. The exhaust valve shaft 20 can extend through both bushings 62 in each of the housings 16. Fasteners 64 can be coupled to the bushings 62 to retain the bushings in place.

As shown in FIGS. 6A-6D, the outer housing 52 can comprise a body portion 72 and a flanged portion 74. The body portion 72 can define a generally rectangular inner passageway for receiving a portion of the inner housing 54 in a nesting manner. An annular edge 76 of the body portion 72 opposite the flange portion 74 can be coupled to the sidewall of the jug 14 such that the annular edge 76 surrounds the exhaust port 34. The body portion 72 can further comprise a sloped lower wall 78 such that the cross-sectional area of the inner passageway increases moving from the annular edge 76 to the flanged portion 74. The body portion 72 can further comprise a pair of aligned openings 58 in either sidewall configured to receive the exhaust valve shaft 20. The flanged portion 74 can comprise a plurality of apertures, such as bolt holes, for securing the inner housing 54 to the outer housing 52.

As shown in FIG. 7A-7D, the inner housing 54 can comprise a body portion 82 and a flanged portion 84. The body portion 82 can be configured to fit within the inner passageway of the outer housing 52 such that the flange portions 74 and 84 can be secured together via apertures 80 and 94. The body portion 82 of the inner housing 54 can comprise an annular edge 86 that can be aligned just inside the annular edge 72 of the outer housing 52 and can also be secured to the side wall of the jug 14 such that it surrounds the outside of the exhaust port 34. The body portion 82 can comprise a generally cylindrical inner valve chamber 88 within which the exhaust valves 22 are housed. A slot 60 can be positioned at either side of the valve chamber 88 to support the valve shaft 20. The slots 60 are aligned with the openings 56 in the outer housing 52 such that the valve shaft 20 can pass through both along a horizontal valve shaft axis 21 (see FIG. 4A). The valve chamber 88 can be centered around the valve shaft axis 21 such that the valves 20 that are fixed to the shaft 20 can rotate around the valve shaft axis 21 with the chamber 88 within the valves passing closely to the radial walls of the chamber 88 but without actually touching any part of the inner housing 54. The inner housing 54 can comprise a sloped lower wall 92 that extends from the annular edge 86 to the flanged portion 84. The lower wall 92 forms part of a downwardly sloped exhaust outlet 90 that extends from the valve chamber 88 along the lower wall 92 to adjacent the flanged portion 84. Gas passing through the exhaust port 34 enters the valve chamber 88 and then passes through the exhaust outlet 90 to downstream exhaust components, such as a tuning pipe.

Figure 8A:
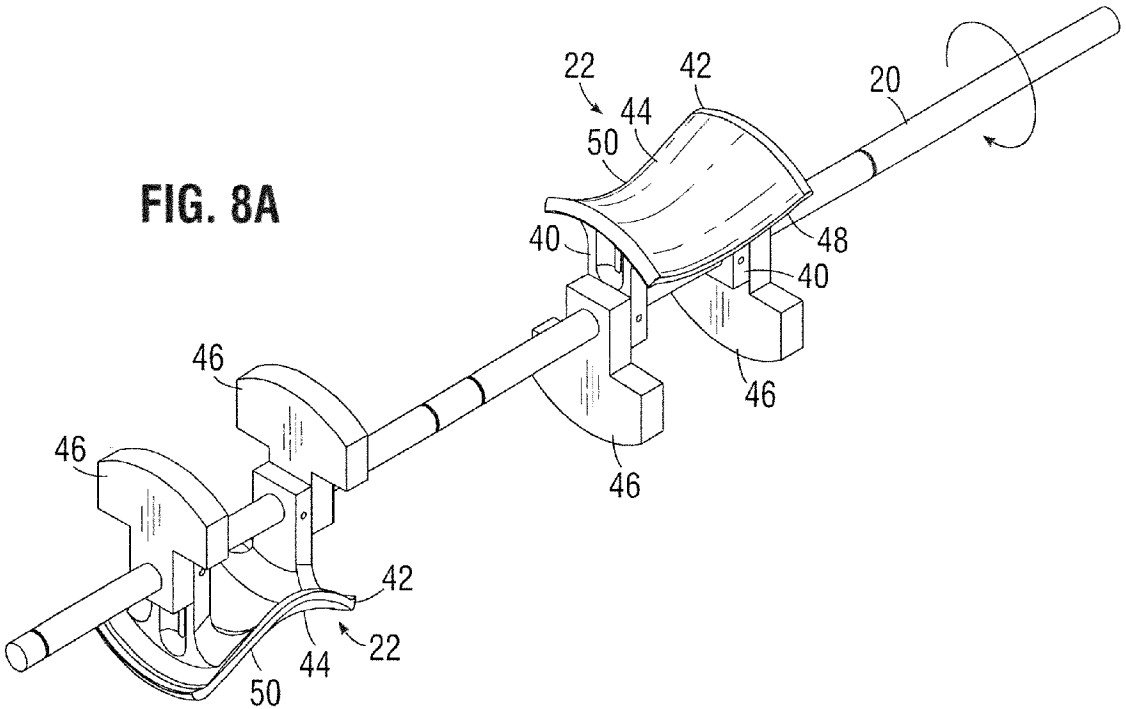
FIGS. 8A and 8B show an exemplary exhaust valve assembly of the engine of FIG. 1.
Figure 8B:
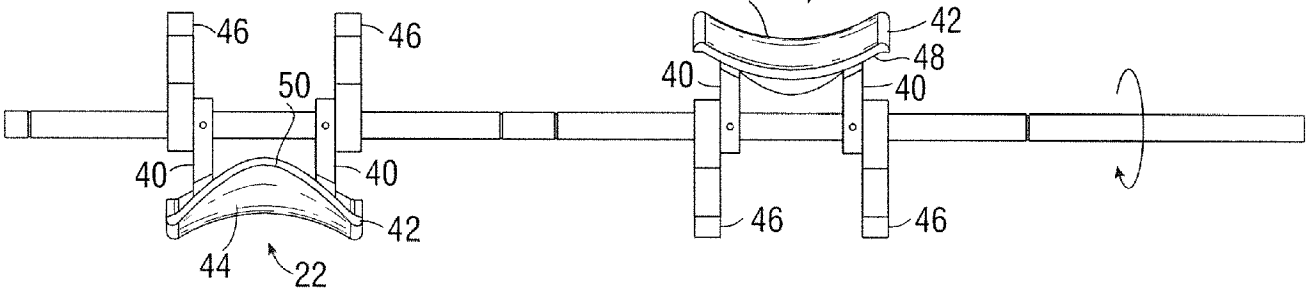

FIGS. 8A and 8B show an exemplary embodiment of the exhaust valve shaft 20 with two single headed exhaust valves 22 fixed thereto at 180° offset orientations. Each valve 22 is positioned axially along the shaft such that is aligned with the exhaust port 34 of one of the two cylinders. As shown in FIGS. 9A-9F, each valve 20 can comprise a base portion 40 coupled to the shaft 20 and a head portion 42 extending radially from the base portion 40. The base portion 40 can comprise a pair of legs and can comprise one or more concentric openings 41 coupled to the shaft 20. The head portion 42 can comprise a face surface 44 having a lead edge 48 and a trail edge 50. Counterweights 46 (see FIGS. 8A and 10) can be coupled to the shaft 20 opposite the valve head portions 42 to balance the rotational inertia of the valves 22 and minimize radial stresses on the shaft.

The face surface 44 can be generally saddle shaped, meaning that the surface has a convex curvature along a first direction and a concave curvature along a second direction that is orthogonal to the first direction. The face surface 44 can comprise a rotation direction, or angular direction, extending between the lead edge and the trail edge, and can comprise an axial, or side-to-side, direction orthogonal to the rotation direction. Along the rotation direction, the face surface 44 can have a convex curvature, such as a convex curvature of substantially constant radius at any given axial position, such as having a center of curvature on the valve shaft axis 21. In some embodiments, the convex curvature in the rotation direction can have a substantially constant radius of curvature at any given axial position over only a portion of the face surface, such as over at least 50% of the face surface 44. The convex curvature in the rotation direction can have a minimum radius of curvature at the center of the face surface and increase in radius of curvature moving toward the sides of the face surface in the axial direction.

In the side-to-side direction, the face surface 44 can have a concave curvature, such as a concave curvature of substantially constant radius. The concave side-to-side curvature can have a substantially constant radius of curvature that is about equal to the radial distance from the centerline of the cylinder bore 26 to the outside of the exhaust port 34. The concave side-to-side curvature can be based on the geometry of the outside of the exhaust port 34. In some embodiments, the side-to-side curvature can have a substantially constant radius of curvature over only a portion of the face surface, such as over at least 50% of the face surface 44. When the valve's face surface 44 is obstructing the outside of the exhaust port 34, the center of curvature of the side-to-side curvature of the face surface 44 can be on or close to the centerline of the cylinder bore 26. As used herein, the terms "substantially constant radius of curvature," "curvature of substantially constant radius," and the like, mean exactly constant radius of curvature or within a minor deviation from exactly constant radius of curvature, such as within a deviation of 5% or 10%, such as would not significantly affect the operation of the engine.

The saddle shaped face surface 44 can comprise a doubly ruled surface. In some embodiments, the convex curvature in the rotation direction and/or the concave curvature in the side-to-side direction can have a non-constant radius of curvature, such as a parabolic or hyperbolic curvature. In some embodiments, the face surface can have the general shape of a hyperbolic paraboloid.

Figure 5B:
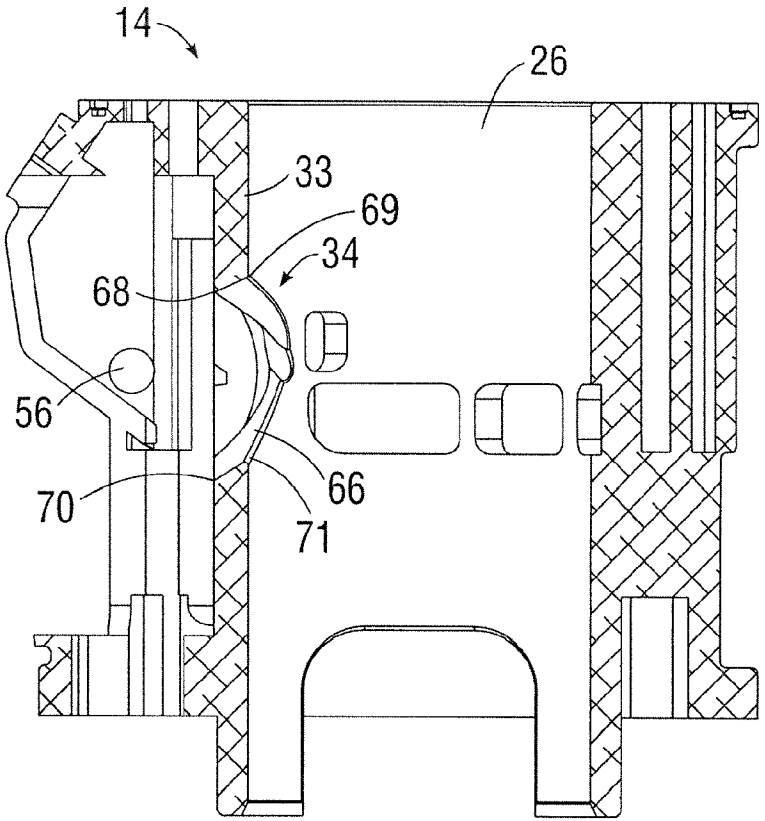
FIG. 5B is a cross-sectional view of the jug of FIG. 5A taken along section line 5B-5B.
Figure 5A:
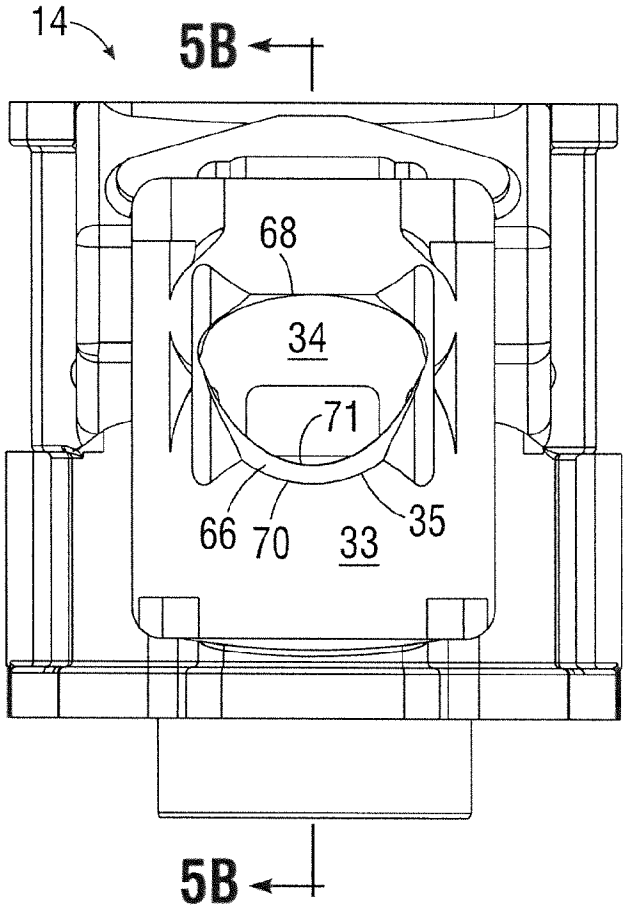
FIG. 5A is a side view of the jug of FIG. 4A showing the outside of an exhaust port.
Figure 6A:
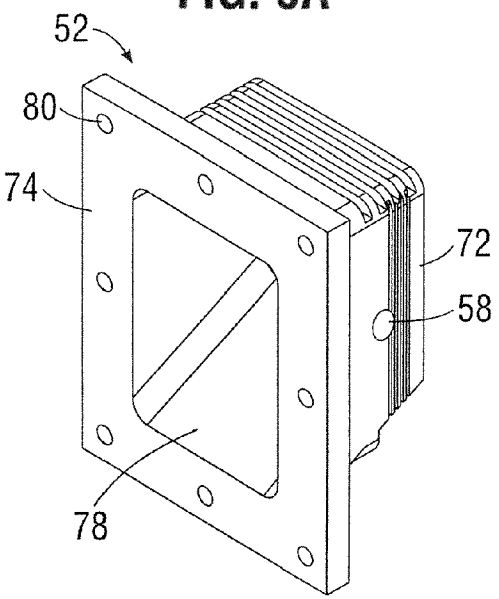
FIGS. 6A-6D show an exemplary outer exhaust valve housing of the engine of FIG. 1.
Figure 6B:
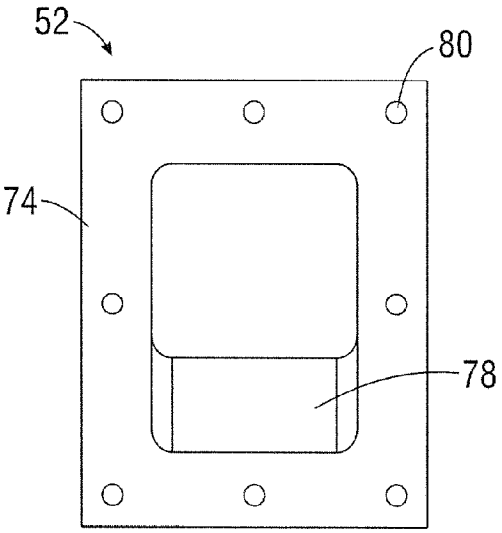
Figure 6C:
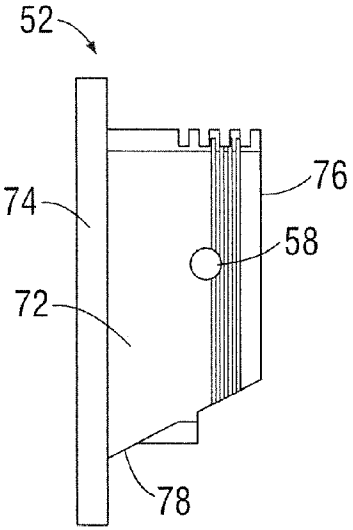
Figure 6D:
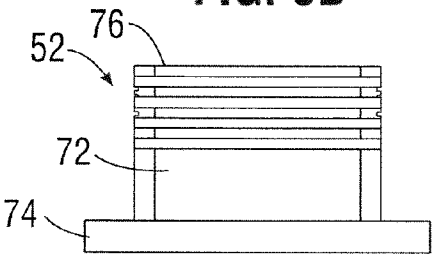
Figure 7D:
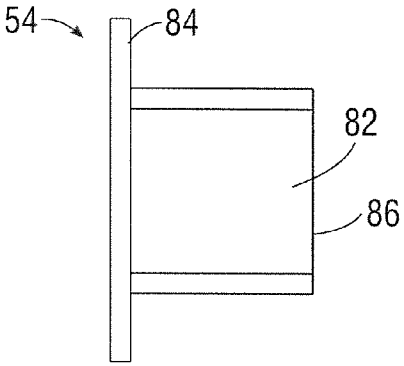
FIGS. 7A-7D show an exemplary inner exhaust valve housing of the engine of FIG. 1.
Figure 7B:
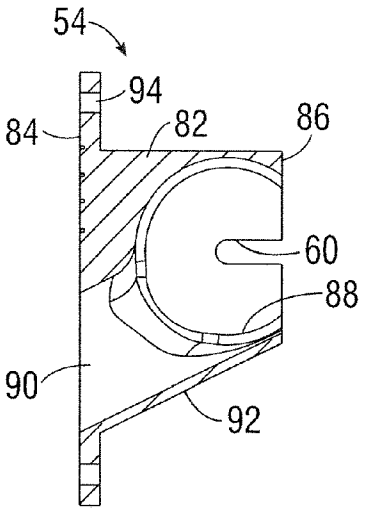
Figure 7C:
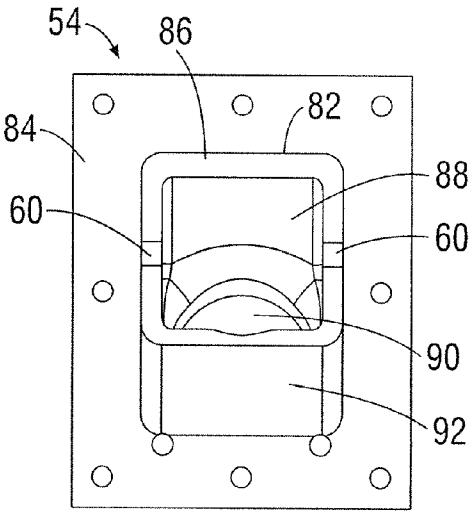
Figure 7A:
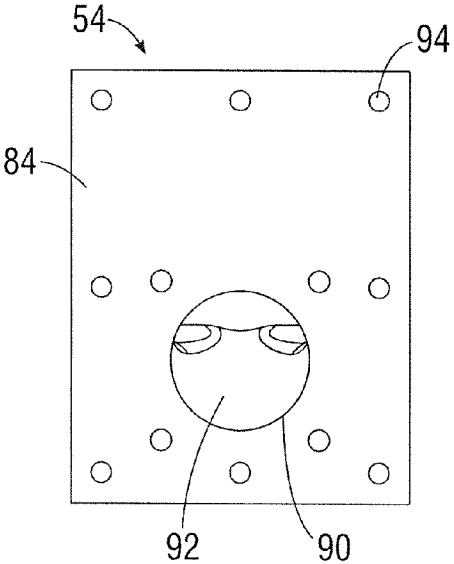

As shown in FIGS. 5A and 5B, the outside of the exhaust port 34 can have an outer perimeter 35 comprising an upper outer edge 68 and a lower outer edge 70. As the valves 22 and the valve shaft 20 rotate about the valve axis 21, the lead edge 48 of the valve approaches the upper outer edge 68 of the exhaust port 34 while moving downward. As the lead edge 48 crosses the upper outer edge 68, the valve begins to obstruct the outside of the exhaust port 34. When the trail edge 50 crosses the lower outer edge 68, the valve no longer obstructs the exhaust port 34. In some embodiments, the lead edge 48 crosses the lower outer edge 70 before the trail edge 50 crosses the upper outer edge 68, such that the valve completely, or nearly completely, obstructs the entire outside of the exhaust port 34. In other embodiments, the trail edge 50 crosses the upper outer edge 68 before the lead edge 48 reaches the lower outer edge 70 such that the valve 22 never completely obstructs the exhaust port 34.

Figure 9A:
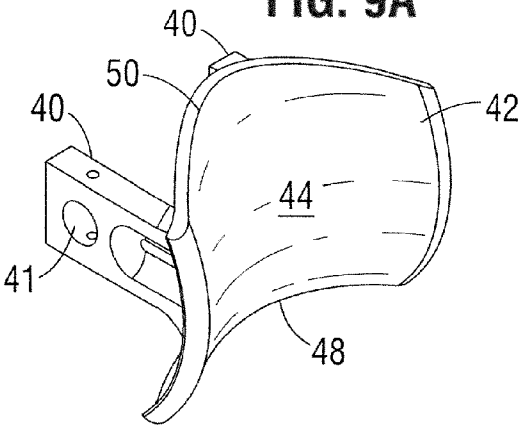
FIGS. 9A-9F show various views of the exhaust valves of the exhaust valve assembly of FIG. 8A.
Figure 9C:
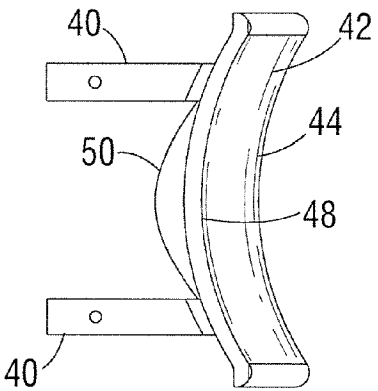
Figure 9B:
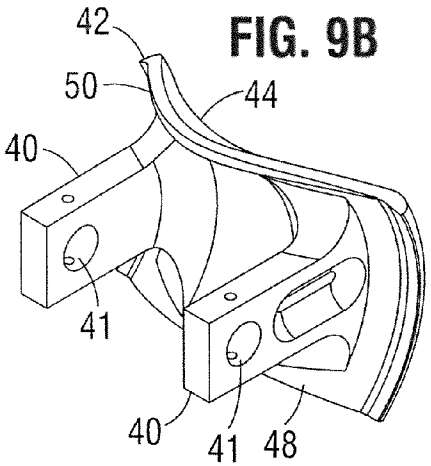
Figure 9F:
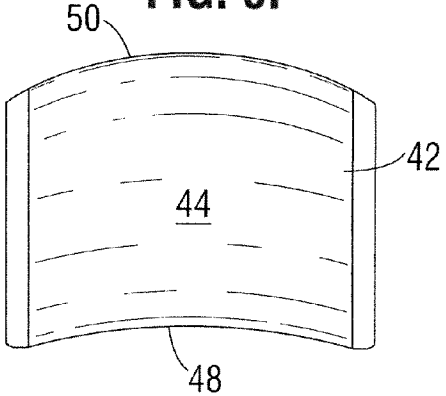
Figure 9D:
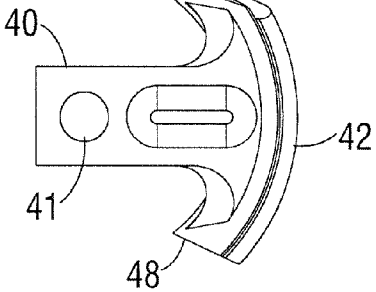
Figure 9E:
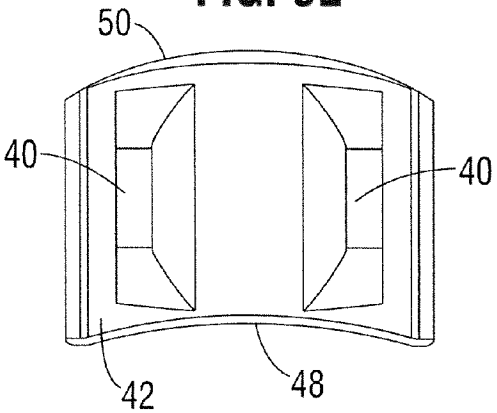
Figure 10:
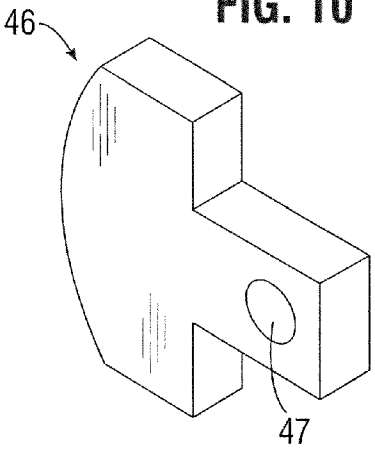
FIG. 10 shows an exemplary counterweight of the exhaust valve assembly of FIG. 8A.

As shown in FIG. 9F, the lead edge 48 can be concave while the trail edge 50 can be convex, when viewed in the radial direction. In some embodiments, the lead edge 48 and the trail edge 48 can be substantially parallel in the radial view of FIG. 9F. The concave lead edge 48 can result in more rapid obstruction of the exhaust port during an initial period after the lead edge 48 crosses the upper outer edge 68, as the upper outer edge can have a similar curvature with the lead edge 48 of the valve. The convex trail edge 50 can result in a more rapid de-obstruction of the exhaust port 34 during a later period after the trail edge crosses the upper outer edge 68, as the trail edge 50 can also have a similar curvature with the lead edge 48 of the valve.

Desirably, as the face surface 44 of the valve 20 passes by and obstructs the outside of the exhaust port 34, the face surface does not make contact with any part of the exhaust port or any part of the surrounding side walls of the jug 14. Instead, the face surface 44 can pass very closely by the outer perimeter 35 of the exhaust port (see FIG. 5A) without contact. For example, there can be a gap of about 20 to about 40 thousands of an inch between the face surface 44 and the outer perimeter 35 of the exhaust port as the valve 22 passes by. The lack of contact can reduce torsional stress on the valves 22 and the valve shaft 20 that would be caused by friction if the face surface 44 were to make contact with the exhaust port. Because the valve is spaced slightly from the exhaust port 34, the valve does not completely obstruct or seal off the exhaust port, and there is always at least some small space through which gas can escape from the cylinder bore and into the valve chamber 88. However, the valve 22 can still substantially obstruct the exhaust port 34 such that a substantial amount of gas is trapped within the cylinder, and the amount of gas that can escape through the gap is relatively insubstantial. The obstruction of the exhaust port 34 by the exhaust valves can help increase the in-cylinder pressure during the compression stroke and thereby increase power output.

In an alternative embodiment of the engine 10, the two or more valves 22 can be associated with each exhaust port. Each of the valves associated with each exhaust port can be spaced angularly around and fixed to the valve shaft 20 at the same axial position. In other embodiments, each valve 22 can comprise two or more head portions 24 spaced angularly around the valve shaft 20 at the same axial position and fixed to the shaft 20 via a common base portion. In these embodiments, the valve shaft 20 can spin at a slower rate relative to the crank shaft 18 such that the exhaust port is obstructed only once for each cycle of the associated piston.

Figure 8C:
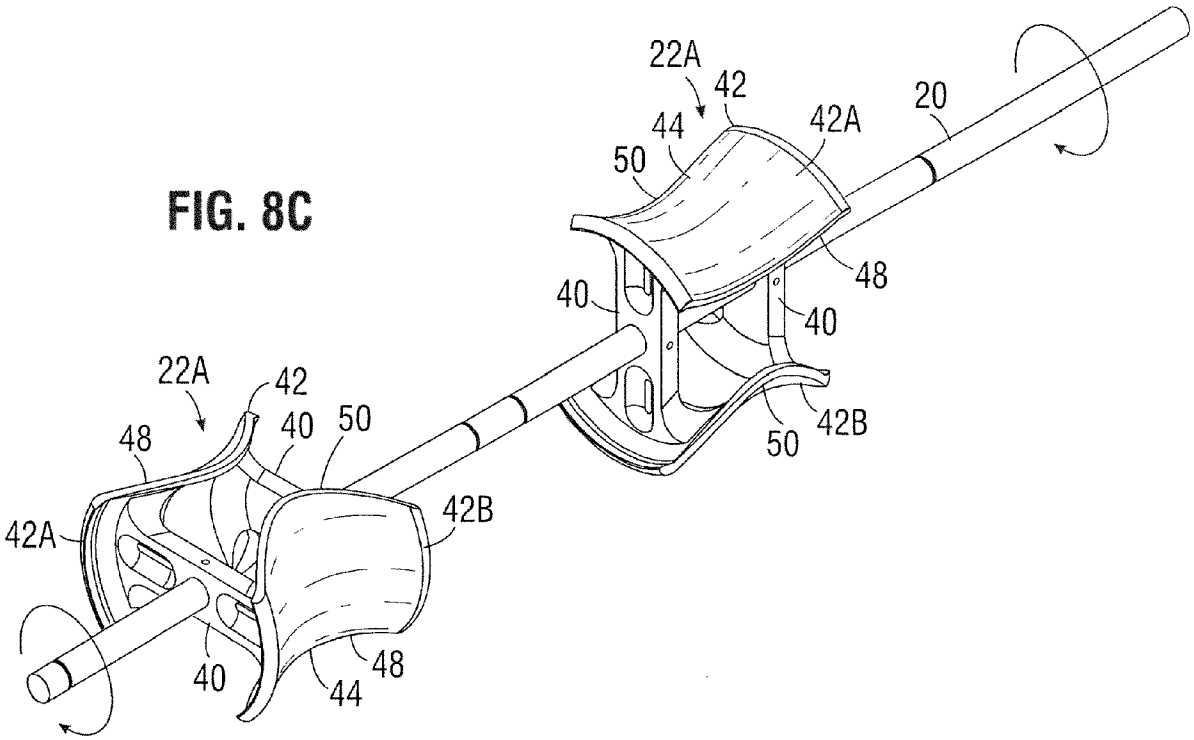
FIGS. 8C and 8D show another exemplary exhaust valve assembly, with double-headed valves.
Figure 8D:
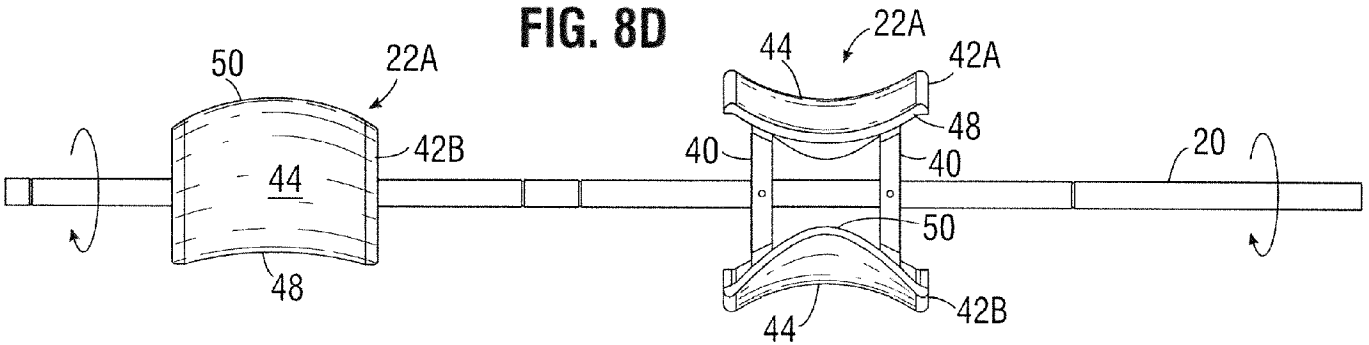
Figure 11A:
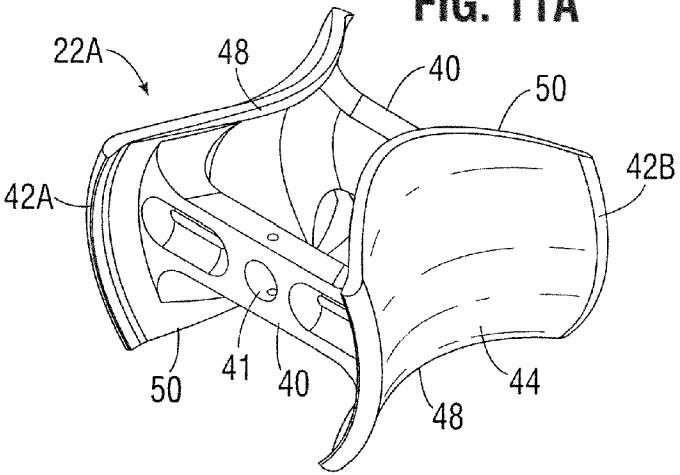
FIGS. 11A-11C show various views of the double-headed exhaust valves of the exhaust valve assembly of FIG. 8C.
Figure 11B:
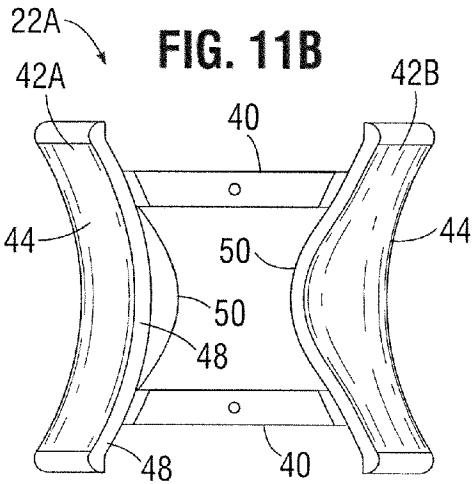
Figure 11C:
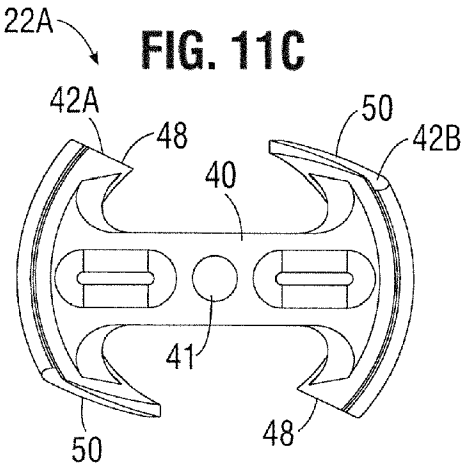
Figure 12A:
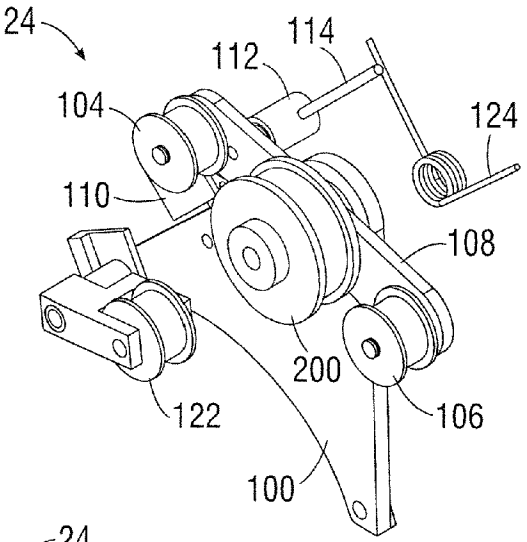
FIGS. 12A-12C show various views of an exemplary variable valve timing system of the engine of FIG. 1.
Figure 12B:
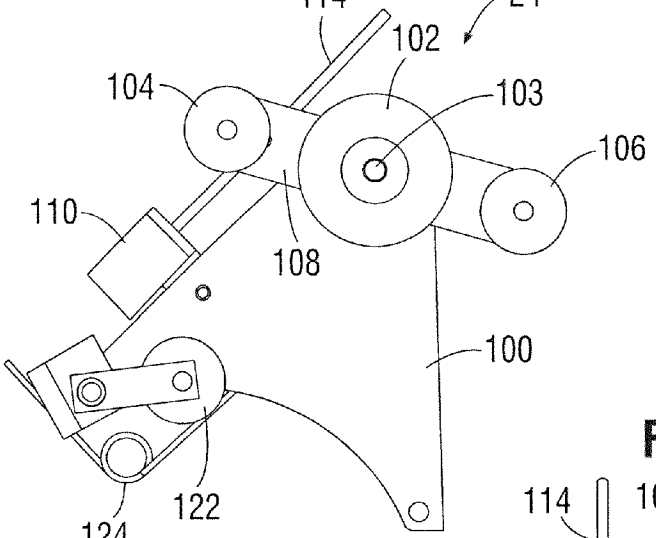
Figure 12C:
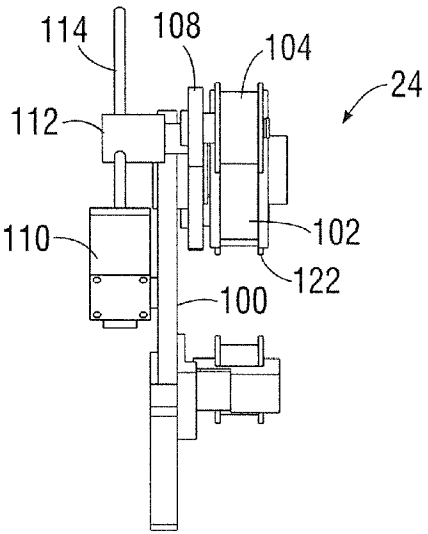

For example, FIG. 8C and 8D show an exemplary embodiment of a valve shaft 20 having two double headed valves 22A fixed thereto at 90° offset orientations. Each valve 22A is positioned axially along the shaft such that is aligned with the exhaust port 34 of one of the two cylinders. As shown in FIGS. 11A-11C, each valve 22A comprises two head portions 42A, 42B that are diametrically aligned with one another and offset 180° about the shaft axis relative to one another. The two head portions 42A, 42B can be identical to one another and can share a common base portion 40 coupled to the shaft 20 via openings 41. The two head portions 42A, 42B can be symmetrical about the shaft axis, such that the lead edge 48 of one follows the trail edge of the other when the valve spins around the shaft axis 21.

Although the embodiments of FIGS. 8C, 8D, and 11A-11C are illustrated with head portions 42A, 42B having the same size as the head portions 42 of FIGS. 9A-9F, in some embodiments, the head portions 42A, 42B of the double headed valves 22A can comprise a shorter distance, or arc length, from the lead edge 48 to the trail edge 50. For example, the arc length of each of the head portions 42A, 42B (measured along the axial center of the face surface) can be about half, or little more than half, of the arc length of the head portion 42 (measured along the axial center of the face surface).

In embodiments of the engine 10 where plural valve heads are associated with each exhaust port 34, the valve shaft 20 can rotate at a lower angular velocity than the crank shaft 18. For example, with the dual headed valves 22A of FIG. 8C and 8D, the shaft 20 can spin at about half of the angular velocity of the crank shaft 18. This results in the one of the two valve heads 42A, 42B obstructing the exhaust port per each cycle of the associated piston. In these embodiments, the valve heads 42A, 42B have a reduced angular velocity. However, their reduced circumferential arc length from lead edge to trail edge can result in the valve face obstructing the exhaust port for about the same period of time as the larger valve heads 42 that move past the exhaust port at a faster angular velocity.

In order to properly time the exhaust valve shaft 20 with the crank shaft 18, the exhaust valve shaft and the crank shaft can be coupled together with timed drive mechanism. The timed drive mechanism can comprise a belt and pulley system 24 shown in FIGS. 1, 2, 12 and 13, or any other suitable variable drive mechanism, such as a gear based system.

Figure 13:
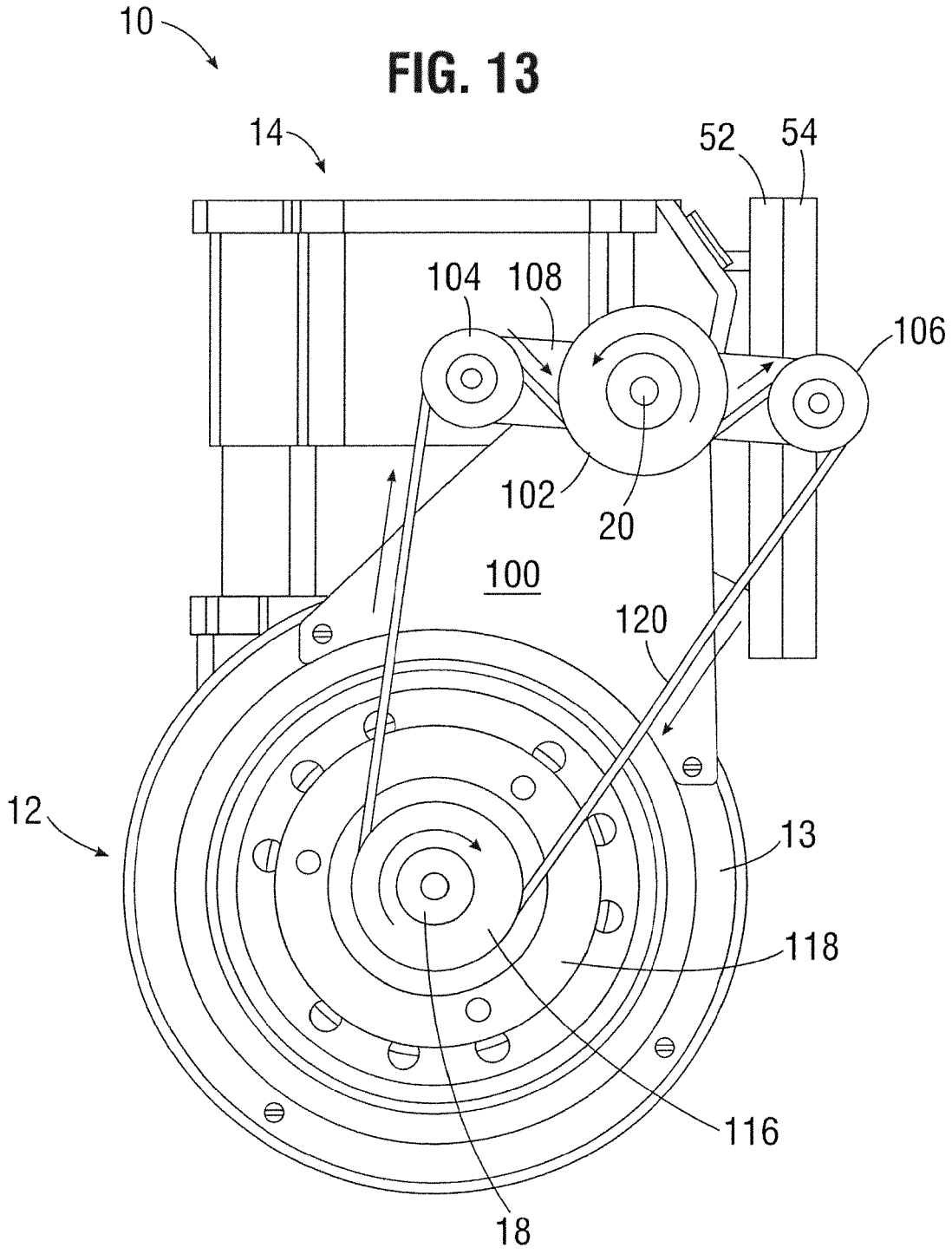
FIG. 13 is an end view of the engine of FIG. 1 showing an exemplary variable valve timing system.

As shown in FIGS. 12A-12C and FIG. 13, the drive system 24 can comprise a bracket 100 coupled to the crank case 12, such as via a flanged portion 13, and pulleys 102, 104, 106 mounted on an arm 108 that is rotatable relative to the bracket 100 about the valve axis 21. A valve shaft pulley 102 can be fixed to the exhaust valve shaft 20, a lead pulley 104 can be mounted on one end of the arm 108 and a trail pulley can be mounted on the other end of the arm 106. A crank pulley 116 (FIG. 13) can be fixed to the crank shaft 18 and rotatably coupled to an end cap 118 that is fixed to the crank case 12. A drive belt 120 can be coupled to the pulleys 102, 104, 106, and 116 as shown in FIG. 13 such that rotation of crank shaft 18 causes an opposite rotation of the exhaust valve shaft 20 with the same angular velocity. In some embodiments, a tensioner pulley 122 can be adjustably coupled to the bracket 100 and configured to adjust the tension of the drive belt 120.

The drive system 24 can further comprise an actuator 110 fixed relative to the bracket 100. Actuator 110 can be configured to actuate a rod 114 that is coupled to a lever 112 that is fixed relative to the arm 108. As the lever 112 is moved relative to the actuator 110, the arm rotates about the valve axis 21 causing the pulleys 104 and 106 to rotate in unison about the valve axis. The rotation of the pulleys 104 and 106 causes a retardation or an advancement of the exhaust valve shaft 20 relative to the crank shaft 18.

The actuator 110 can comprise a servo or other type of electrically controlled actuator. Actuator 110 can be electronically coupled to a controller (not shown), such as a microprocessor-based controller or the like, that can be programmed to vary the timing of the exhaust valve shaft 20 relative to the crank shaft 18, such as based on one or more input variables.

In other embodiments, a gear-based system (not shown) can be used to drive the valve shaft 20. For example, a first gear can be coupled to the crank shaft 18 and a second gear can be coupled to the valve shaft 20. The two gears can be coupled together, optionally by additional gears, such that they rotate at the same rate in opposite directions. One of the gears can comprise a phasing mechanism in order to vary the timing of the valve shaft 20 relative to the crank shaft 18. The phasing mechanism can be electronically controlled by a controller based on one or more input variables.

Varying the timing of the valve shaft 20 relative to the crank shaft 18 causes the valves 22 to obstruct the exhaust ports 34 at different times relative to when the pistons 30 cover and uncover the exhaust ports. Different timings can be optimal or advantageous for different circumstances, such as depending on the angular velocity of the crank shaft, the throttle position of the engine, the temperature of the exhaust gas, and/or other engine properties.

A first exemplary timing is as follows. The piston 30 opens the exhaust port 34 moving downward during the combustion stroke before the lead edge 48 of the valve 22 arrives, as shown in FIG. 3A. When the piston reaches bottom dead center (BDC), the exhaust port 34 is fully open and the lead edge 48 of the valve still has not reached to upper outer edge 68 of the exhaust port. At BDC, fresh charge is entering the combustion chamber, pushing the exhaust gas out through the exhaust port 34. At about 40° after BDC, as the piston is moving upward during the compression stroke, the lead edge 48 of the valve reaches the upper outer edge 68 of the exhaust port 34 and begins obstructing the exhaust port. At about 100° before top dead center (TDC), the lead edge 48 of the valve and the upper perimeter 37 of the piston reach the same elevation near the center of the exhaust port 34, as shown in FIG. 3B. As this point, the piston 30 covers the part of the exhaust port 34 and the valve 22 obstructs the upper part of the exhaust port, leaving only a small gap between the face surface 44 and the side wall 36 for gas to escape from the cylinder. At this point, the exhaust port 34 is effectively closed, trapping the charge gas inside the combustion chamber. Without the valve 22, the exhaust port 34 would remain partially open until the upper perimeter edge 37 of the piston travels to the top of the exhaust port 34, allowing more gas to escape. The trail edge 50 of the valve reaches the upper outer edge 68 of the exhaust port 34 at the same time as or after the piston 30 reaches the upper outer edge, such that the exhaust port remains closed during the whole portion of the combustion stroke after the point shown in FIG. 3B.

This first timing can be well suited for situations where the engine is under a relatively low load, such as when the crank shaft has a low angular velocity, such as below 3,000 RPM, and/or when the throttle is mostly closed. Under such low load situations, it can be beneficial to close the exhaust port 34 early to trap more fresh charge in the combustion chamber, thereby reducing emissions and increasing torque and fuel efficiency.

When the engine is under higher loads, however, in can be desirable to leave the exhaust port 34 open for a longer period of time during each piston cycle. Thus, at higher engine speeds, such as above 3,000 RPM, and/or when the throttle is more open, the drive system 24 can be adjusted in order to retard the timing of the valve shaft 20 relative to the crank shaft 18. For example, the actuator 110 can cause the arm 108 to rotate, which causes the valve shaft 20 to be retarded a desirable amount. In one exemplary embodiment, retarding the valve shaft 20 about 20° to about 30° from the first exemplary timing discussed above causes the lead edge 48 of the valve 22 to reach the upper outer edge 68 of the exhaust port 34 at the same time or after the piston reaches to top of the exhaust port. Under this fully retarded timing, the exhaust port 34 is left open for the maximum time and the exhaust valve 22 does not obstruct the exhaust port during any portion of the time when it is at least partially uncovered by the piston. This fully retarded timing allows a maximum amount of gas to escape the combustion chamber during each piston cycle.

One of ordinary skill in the art will understand that the timing of the valve shaft 20 relative to the crank shaft 18 can similarly also be adjusted to any other timing as desired. Furthermore, the timing can be gradually adjusted during between two or more settings in an analog manner using an analog mechanism, such as a servo motor or other similar device. For example, as the engine RPM gradually increases, such as over a predetermined RPM range, the valve shaft 20 can be correspondingly gradually retarded from a first setting to a second setting. The controller can be programmed to vary the timing of the valve shaft 20 any desirable manner relative to the crank shaft 18 based on any desirable factors.

Although not shown, one or more exhaust headers and/or tuning pipes can be coupled downstream of the outlets 90 of the inner housings 54. The header(s), if present, can collect two or more exhaust flows from the outlets 90 into a single exhaust flow. The tuning pipe(s) can help retain the air/fuel mixture in the combustion chamber by using the pressure wave produced by the combustion process itself and reflecting it back to the exhaust port 34 at the appropriate time, thus precluding the fresh charge from following the exhaust gases out through the exhaust port. The tuning pipe(s) can work with the exhaust valves 22 to help minimize the amount of fresh charge that escapes through the exhaust ports 34. In some embodiments, the tuning pipes(s) can be tuned for an engine condition with a high engine speed, such as a maximum or red line speed of the engine, and with the exhaust valves having a fully retarded timing.

Some embodiments of the engine 10 can further comprise a mechanism for varying the height of the exhaust port 34. For example, some embodiments can include a guillotine-type power valve or other means for changing the vertical dimension of the exhaust port.

Figure 14:
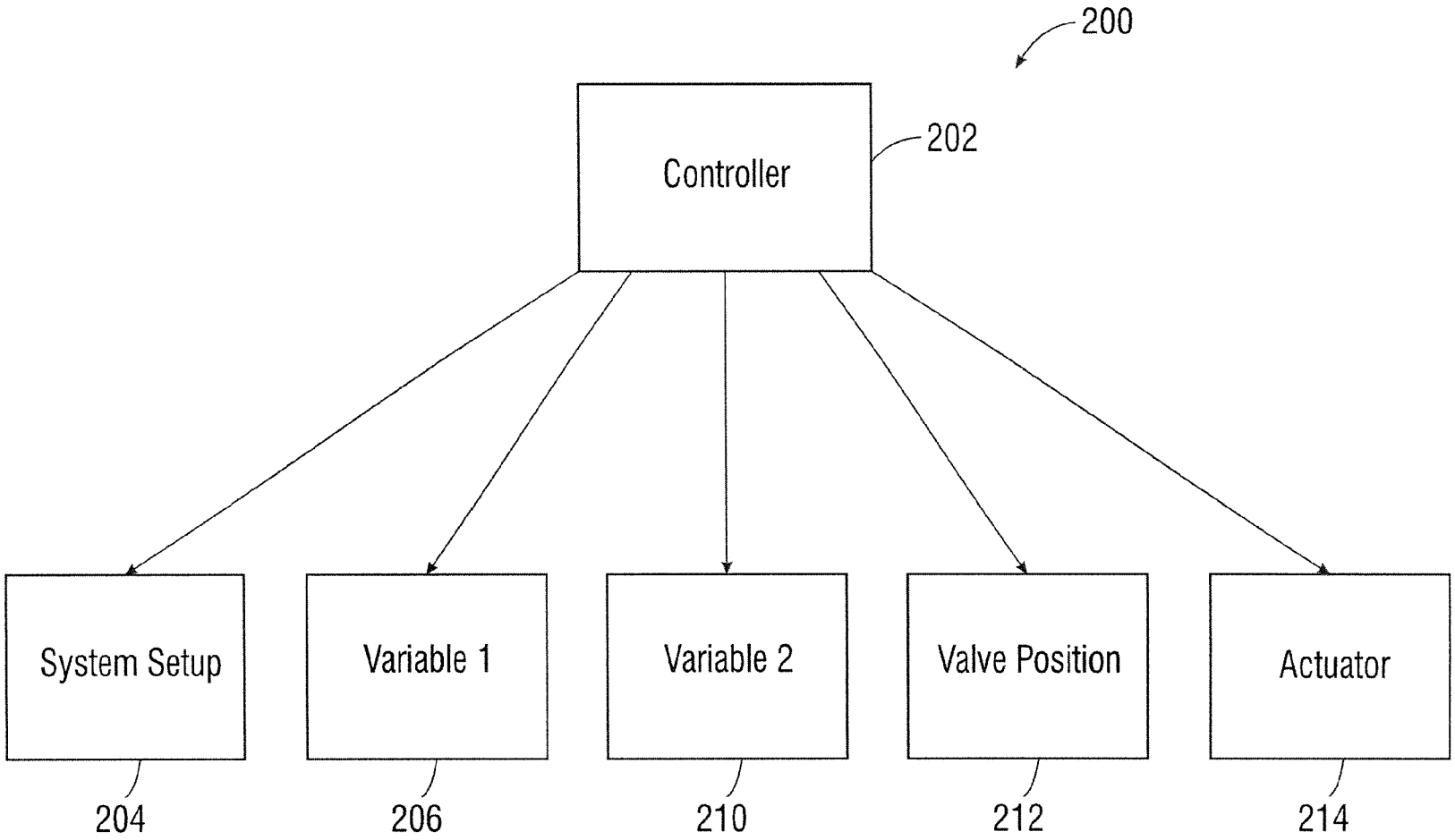
FIG. 14 illustrates an exemplary valve timing control system.

As shown in FIG. 14, an electronic control system 200 of the engine 10 can comprise a controller 202, a system setup module 204, a signal source for a first variable 206, optionally a signal source for a second variable 208, any number of additional signal sources for additional variables, a signal source for valve position 212, and an actuator 214 for physically varying the timing of the engine. The controller 202 can comprise any conventional programmable computing device, and can comprise conventional computing components, such as a processor, memory, and input-output devices. The controller 202 can interact with the system setup module 204 to initialize the control system 200 and/or to make changes to the timing control logic. The controller can interact with the signal sources 206, 210, which can comprise sensors or other computer systems related to the engine, and the valve position signal source, to read the current state of the relevant engine variables, such as engine RPM, throttle position, exhaust gas temperature, current valve position, etc. For example, the controller 202 can read engine RPM and throttle position signals from another computing device electrically coupled to the engine. Based on the input variable values received, the controller 202 can cause the actuator 214 to vary the timing of the valves 22, such as according to a preprogrammed algorithm stored in the controller's memory.

Figure 15:
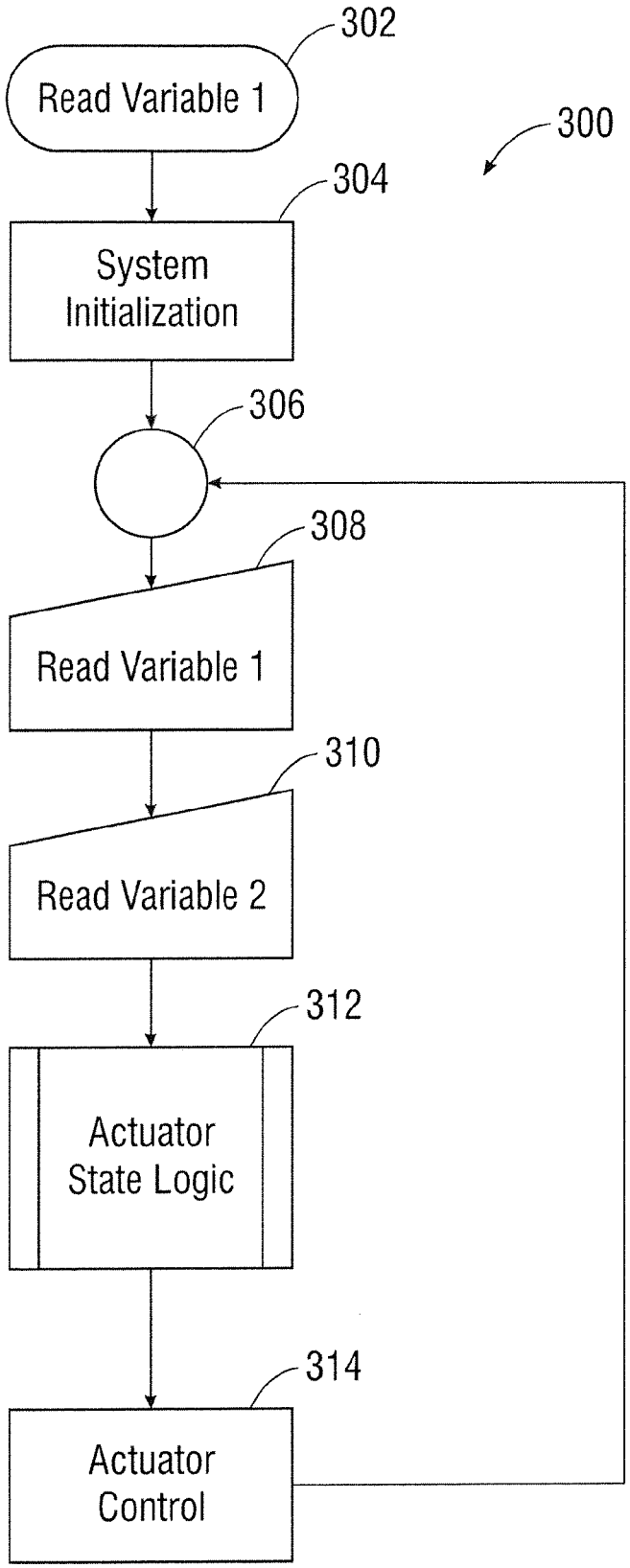
FIG. 15 illustrates an exemplary valve timing control algorithm.

FIG. 15 illustrates an exemplary algorithm 300 executed by the controller 202. At 302, the controller 202 can first read a first engine variable, such as throttle position. At 304, a system initialization can occur in response to the first variable read, such as if the throttle opens beyond a predetermined threshold. At 308 and 310, the controller can then request and receive signals indicating the current values of a one or more engine variables, such as engine RPM and throttle position. At 312, the controller can perform actuator state logic to determine how the actuator needs to be moved to vary the timing a desirable amount. At 314, the controller then causes the actuator to move, thereby adjusting the timing of the valves. The algorithm can then return to juncture 306 and repeat 308 through 314 continuously. This repeating cycle can end, for example, if the engine variable read at 308 falls below a predetermined threshold value.

Varying the valve timing based on the engine condition can help optimize the torque output of the engine, reduce emissions, and/or increase fuel efficiency across all or a portion of the RPM range of the engine. The variable valve timing can result in a more even torque band across the RPM range of the engine. The two stroke engines described herein can be used in a wide variety of applications, including but not limited to snowmobiles, motorcycles, ATVs, automobiles, watercrafts, chain saws, lawnmowers, power tools, and the like.

In view of the many possible embodiments to which the principles disclosed herein may be applied, it should be recognized that the illustrated embodiments are only preferred examples and should not be taken as limiting the scope of the disclosure. Rather, the scope of the disclosure is defined by the following claims. We therefore claim all that comes within the scope of these claims.

We claim:

1. A two-stroke internal combustion engine, comprising:

one or more cylinders, each cylinder comprising an exhaust port;

one or more pistons positioned with the one or more cylinders, each piston configured to cyclically cover and uncover an associated exhaust port during reciprocation of the pistons within the cylinders; and one or more exhaust valves associated with each exhaust port, the exhaust valves being configured to rotate on an exhaust valve shaft around a valve axis that is substantially parallel to an axis of rotation of a crank shaft of the engine, each exhaust valve being configured to at least partially obstruct the associated exhaust port during a portion of the exhaust valve's rotation about the valve axis while the associated exhaust port is at least partially uncovered by the associated piston;

wherein the one or more exhaust valves comprise at least two exhaust valves associated with each exhaust port.

2. The engine of claim 1, wherein the one or more exhaust valves each comprise a base portion fixed to the exhaust valve shaft and at least one head portion extending radially from the base portion, wherein the exhaust valves and the exhaust valve shaft are continuously rotatable 360° about the valve axis.

3. The engine of claim 1, wherein each exhaust valve comprises a radially facing, saddle-shaped face surface configured to obstruct the associated exhaust port.

4. The engine of claim 1, wherein each exhaust valve comprises a radially facing face surface configured to obstruct the associated exhaust port without contacting the exhaust port.

5. The engine of claim 1, wherein the timing of the exhaust valve rotation relative to the piston reciprocation is variable based at least in part on the angular velocity of the crank shaft.

6. The engine of claim 1, wherein the crank shaft and the one or more exhaust valves are configured to rotate in opposite directions.

7. The engine of claim 1, wherein the one or more cylinders comprise at least two cylinders and the one or more exhaust valves comprise at least one exhaust valve associated with each of the cylinders, wherein the at least one exhaust valve associated with a first cylinder is angularly offset about the exhaust valve axis relative to the at least one exhaust valve associated with a second cylinder.

8. The engine of claim 1, further comprising a timing mechanism coupling the crank shaft with the exhaust valve shaft that is configured to vary the timing of the exhaust valve shaft relative to the crank shaft, wherein the timing is varied based at least in part on rotational velocity of the crank shaft and a throttle position of the engine.

9. The engine of claim 1, further comprising a valve housing coupled to each cylinder, each valve housing comprising an inlet in exhaust receiving communication with the associated exhaust port, a valve chamber housing the one or more exhaust valves associated with the exhaust port, and an outlet for expelling exhaust from the valve housing.

10. A vehicle including the engine of claim 1.

11. The vehicle of claim 10, wherein the vehicle is a snowmobile, a wheeled land vehicle, or a watercraft.

12. A two-stroke internal combustion engine, comprising:

one or more cylinders, each cylinder comprising an exhaust port;

one or more pistons positioned with the one or more cylinders, each piston configured to cyclically cover and uncover an associated exhaust port during reciprocation of the pistons within the cylinders; and one or more exhaust valves associated with each exhaust port, the exhaust valves being configured to rotate on an exhaust valve shaft around a valve axis that is substantially parallel to an axis of rotation of a crank shaft of the engine, each exhaust valve being configured to at least partially obstruct the associated exhaust port during a portion of the exhaust valve's rotation about the valve axis while the associated exhaust port is at least partially uncovered by the associated piston;

wherein the one or more cylinders comprise at least two cylinders and the one or more exhaust valves comprise at least one exhaust valve associated with each of the cylinders, wherein the at least one exhaust valve associated with a first cylinder is angularly offset about the exhaust valve axis relative to the at least one exhaust valve associated with a second cylinder.

13. The engine of claim 12, wherein the one or more exhaust valves each comprises a base portion fixed to the exhaust valve shaft and at least one head portion extending radially from the base portion, wherein the exhaust valves and the exhaust valve shaft are continuously rotatable 360° about the valve axis.

14. The engine of claim 12, wherein each exhaust valve comprises a radially facing, saddle-shaped face surface configured to obstruct the associated exhaust port.

15. The engine of claim 12, wherein each exhaust valve comprises a radially facing face surface configured to obstruct the associated exhaust port without contacting the exhaust port.

16. The engine of claim 12, wherein timing of the exhaust valve rotation relative to the piston reciprocation is variable based at least in part on the angular velocity of the crank shaft.

17. The engine of claim 12, wherein the crank shaft and the one or more exhaust valves are configured to rotate in opposite directions.

18. The engine of claim 12, wherein the one or more exhaust valves comprise at least two exhaust valves associated with each exhaust port.

19. The engine of claim 12, further comprising a timing mechanism coupling the crank shaft with the exhaust valve shaft that is configured to vary the exhaust valve shaft timing relative to the crank shaft, wherein the timing is varied based at least in part on rotational velocity of the crank shaft and a throttle position of the engine.

20. The engine of claim 12, further comprising a valve housing coupled to each cylinder, each valve housing comprising an inlet in exhaust receiving communication with an associated exhaust port, a valve chamber housing the one or more exhaust valves associated with the exhaust port, and an outlet for expelling exhaust from the valve housing.

21. A vehicle including the engine of claim 12.

22. The vehicle of claim 21, wherein the vehicle is a snowmobile, a wheeled land vehicle, or a watercraft.

* * * * *